US006065420A

United States Patent [19]

Smith

[11] Patent Number: 6,065,420

[45] Date of Patent: May 23, 2000

[54] PORTABLE TRANSDUCER MOUNT

[76] Inventor: Gregory L. Smith, 2616 SE. Front St., Hoxie, Ark. 72433

[21] Appl. No.: 09/288,050

[22] Filed: Apr. 7, 1999

Related U.S. Application Data

[60] Provisional application No. 60/081,455, Apr. 13, 1998.

[51] Int. Cl.[7] ..... B63B 17/00

[52] U.S. Cl. ..... 114/343; 114/364

[58] Field of Search ..... 114/343, 364, 114/219, 221 R; 248/291.1, 278.1, 642

[56] References Cited

U.S. PATENT DOCUMENTS

| | | | |
|---|---|---|---|
| 3,752,431 | 8/1973 | McBride | 248/291 |
| 3,989,216 | 11/1976 | Veatch | 248/278 |
| 4,751,891 | 6/1988 | Wilson | 114/219 |
| 5,700,172 | 12/1997 | Ousley, II et al. | 440/88 |

*Primary Examiner*—Stephen Avila
*Attorney, Agent, or Firm*—John M. Harrison

[57] ABSTRACT

A portable transducer mount for positioning a transducer in the water forwardly of a barge or other floating vessel, which mount includes an elongated, hollow mount shaft having one end fitted with a mount collar or sleeve and the other end of the mount shaft terminated by a spring and a hollow shaft leg. A pair of collar legs extend from the mount collar to the vessel for removably and adjustably securing the mount shaft to the bow of the vessel. The transducer is mounted on the shaft leg and the spring connecting the mount shaft and the shaft leg is designed to facilitate deflection of the shaft leg and the transducer rearwardly if the transducer or shaft leg strikes a submerged object. Guys or cables attached to eye bolts connected to the mount shaft serve to stabilize the mount shaft in position on the bow of the barge or vessel. Vertical and rotational adjustment of the mount shaft in the mount collar with respect to the bow of the barge or vessel is effected by manipulation of a pair of clamp pins threaded in a two-piece collar clamp mounted on the mount collar and engaging the mount shaft. The collar legs are typically pivotally mounted on the mount collar and have pivoting collar feet for pivotally contacting the vessel when the portable transducer mount is deployed.

19 Claims, 2 Drawing Sheets

PORTABLE TRANSDUCER MOUNT

BACKGROUND OF THE INVENTION

Cross-Reference to Related Applications

This application claims the benefit of copending Provisional Application Ser. No. 60/081,455, filed Apr. 13, 1998.

FIELD OF THE INVENTION

This invention relates to acoustic marine transducer brackets for boats and more particularly, to a portable transducer mount for securing a transducer in a submerged condition from the bow of a floating barge or vessel to monitor water depth and/or water bottom conditions. In a preferred embodiment the portable transducer mount includes an elongated, hollow mount shaft extending through an adjustable collar clamp attached to a mount collar having a pair of projecting, typically hinged collar legs fitted with pivoting feet for removably and adjustably mounting the mount collar and mount shaft on the bow of the barge or vessel. The two-piece collar clamp element of the mount collar is typically attached to the mount collar, engages the mount shaft and is provided with a pair of clamp pins for adjusting the mount shaft vertically and rotationally with respect to the mount collar and the bow of the barge or vessel. The lower end of the mount shaft is fitted with a spring and the opposite end of the spring carries a hollow shaft leg which extends the mount shaft downwardly and terminates at a transducer, which is typically located beneath the waterline for indicating the depth of the water and/or tracking the contour of the water bottom. Guys or cables stabilize the transducer mount on the barge or vessel and a transducer cable extends from the submerged transducer, through the shaft leg, spring and mount shaft and from the top of the mount shaft to an electronic depth finder, which may be mounted at a suitable location on the barge or vessel or elsewhere, such as in the tow boat or tug, as desired. The spring positioned between the mount shaft and shaft leg typically includes a pair of hollow pins secured at each end to the mount shaft and shaft leg, respectively, and to the spring and facilitates deflection of the shaft leg and the transducer rearwardly in the event the submerged transducer or the shaft leg strikes an underwater object.

One of the problems which is inherent in the transportation of cargo by water and particularly, by barge on various waterways is that of continuously monitoring the depth of the water and in some instances, the contour of the water bottom, while the barge or barges are being pushed or pulled by a tow boat or boats. Valuable time, in addition to cargo, may be lost under circumstances where the barge or barges are accidentally grounded on a sandbar, shoal or other shallow area in a river or waterway. Accordingly, positioning a depth finding device of some description on the lead barge or vessel in the tow is highly desirable. Conventional mounts and brackets for positioning an acoustic marine hydroplane transducer in the water for the purpose of monitoring the water depth, typically include an elongated rod or pole having a bracket or mount of various design for securing the rod or pole to the bow of a barge or vessel and fitted with a trip hinge and outrigger spring device near the bottom above a transducer mounted on the extreme end of the rod or pole. The trip hinge and spring mechanism allow rearward extension of a bottom portion or segment of the rod or pole and the transducer, under circumstances where the transducer or the rod or pole strikes a submerged object. The outrigger spring, which operates in combination with the trip hinge to achieve this effect, is often cumbersome and difficult to operate, as well as usually non-adjustable in the hinged mounting of the rod or a pole on the end of a barge or other vessel. Transportation and storage of these cumbersome prior art devices is awkward and difficult due to the complexity of design.

The use of transducers and depth finders to determine the depth of water and the contour of water bottoms has long been used, primarily as a navigation aid and in the location of fish in both salt water and fresh water fishing. These devices are well known in the art and typically include an acoustical transducer mounted beneath the surface of the water and attached by means of a transducer cable to an electronic depth finder or locator device which includes a screen, across which the bottom topography is typically scrolled and/or the depth of the water indicated. The devices are not only useful in locating fish but are also valuable indicators of water depth when used in navigation to avoid grounding of a ship, barge or other vessel.

An object of this invention is to provide a new and portable, light-weight, collapsible transducer mount for positioning on the bow of barges and other floating vessels and determining the water depth and/or the water bottom topography in a river, lake or waterway floating the barge or vessel. The portable transducer mount includes an elongated, hollow mount shaft fitted at one end with a mount collar and hinged collar leg combination for removably and adjustably securing the mount shaft on the bow of the barge or vessel. A spring is provided on the mount shaft near the bottom thereof to secure a hollow shaft leg extending below the spring for mounting the transducer in a submerged condition forwardly of the bow of the barge or vessel. Guys or cables are also attached to the mount shaft and extend to the barge or vessel for stabilizing the mount shaft on the barge or vessel and maintaining the transducer in the desired submerged position.

Another object of this invention is to provide a new and improved portable transducer mount which includes a typically cylindrically-shaped mount collar provided with a split collar clamp and a pair of pivoting collar legs having pivoting feet for adjustably and removably mounting an elongated, hollow mount shaft on the bow of a water-bourne barge or other vessel. A spring is provided on the mount shaft between the transducer and the mount collar to allow deflection of the lower portion of the mount shaft below the spring and the transducer rearwardly, in the event that the transducer or lower portion of the mount shaft contacts a submerged object or obstacle. Stabilizing wires, guys or cables extend from the mount shaft to the barge or vessel to further secure and stabilize the transducer mount in a desired position with the transducer submerged in the water.

Yet another object of this invention is to provide a new and improved portable transducer mount for mounting on the bow of barges or other vessels and suspending a transducer in a submerged condition forward of the bow in order to monitor water depth and/or bottom topography. The portable transducer mount includes an elongated, hollow mount shaft fitted with a typically cylindrical mount collar carrying a split collar clamp for adjustably and removably receiving the mount shaft; a pair of hinged collar legs extending from the mount collar to the bow of the barge or vessel and pivoting, optionally magnetic, feet provided on the collar legs for pivotally contacting the barge or vessel and supporting the mount collar and mount shaft on the vessel. The lower end of the mount shaft receives a hollow pin mounted on end of a spring, the opposite end of which spring is attached to a second hollow pin attached to a hollow shaft leg. The shaft leg extends the mount shaft below the spring and receives the transducer and locates the transducer in a submerged condition forward of the bow of the barge or vessel. Eye bolts are provided in spaced-apart relationship with respect to each other on the mount shaft for attaching the spring to the mount shaft and for receiving guys or cables extending to the barge or vessel and stabilizing the mount shaft in position on the barge or vessel to facilitate location of the transducer in the desired submerged condition ahead of the bow of the barge or vessel.

SUMMARY OF THE INVENTION

These and other objects of the invention are provided in a new and improved, portable transducer mount which includes in a preferred embodiment, an elongated, hollow, typically fiberglass mount shaft extending downwardly in close proximity to the bow of a barge in a tow and fitted with a typically cylindrical mount collar having a split collar clamp provided with a pair of clamp pins to facilitate vertical and limited rotational adjustment of the mount shaft in the mount collar with respect to the bow of the barge. A pair of collar legs diverge from pivotal and hinged attachment to the mount collar and are fitted with collar feet, typically mounted in a pivotal configuration and optionally magnetic, for pivotally contacting the metal bow or deck of the barge. A spring is fitted to the bottom end of the mount shaft and a hollow shaft leg extends from the opposite end of the spring along the longitudinal axis of the mount shaft and mounts a transducer. Guys or cables are connected to the top and bottom ends of the mount shaft and to the barge for stabilizing purposes. The transducer is typically characterized by a transducer foot fitted with an elongated, threaded transducer mount extending from the top of the transducer foot. The transducer mount is typically inserted through an aperture in a transducer mounting plate on the bottom end of the shaft leg and fitted with a retaining or mount nut, which is threaded on the end of the transducer mount to secure the transducer foot in position against the transducer mounting plate. The threaded transducer mount extends above the retaining nut into the bore of the shaft leg. The transducer cable extends through the bore of the shaft leg, the spring and the mount shaft to an electronic depth finder or viewer for continuously reading the water depth and/or water bottom topography.

BRIEF DESCRIPTION OF THE DRAWINGS

The invention will be better understood by reference to the accompanying drawing, wherein.

DESCRIPTION OF THE PREFERRED EMBODIMENTS

Figures 1, 2:
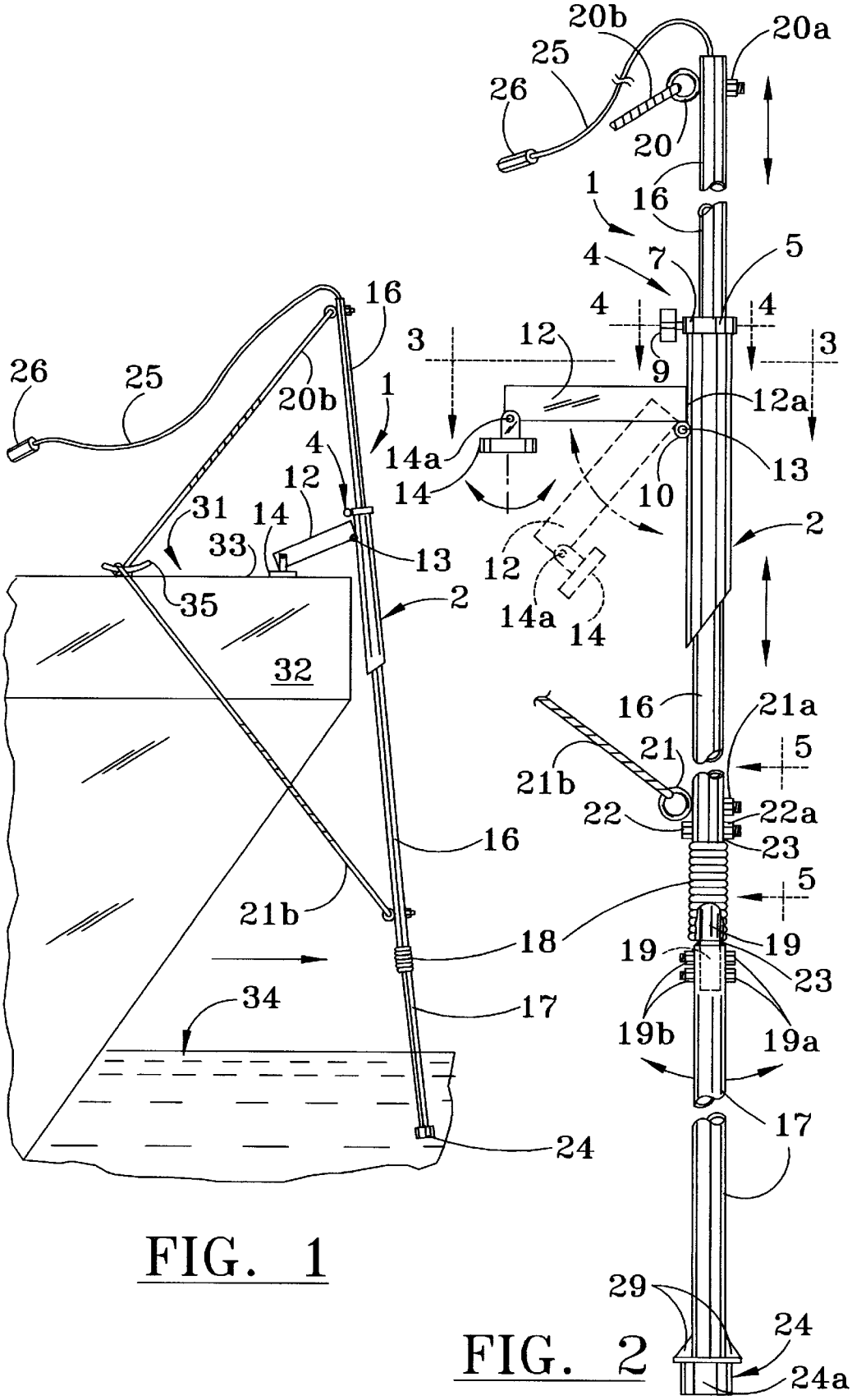
FIG. 1 is a side view of a typical portable transducer mount of this invention, mounted in functional configuration on the bow of a barge, with the transducer submerged forwardly of the barge in bottom and/or water depth-reading configuration.
FIG. 2 is an enlarged view, partially in section, of the portable transducer mount illustrated in FIG. 1 detached from the barge, more particularly illustrating a preferred mount shaft, mount collar, split collar clamp, spring, shaft leg and other elements of the portable transducer mount.
Figure 3:
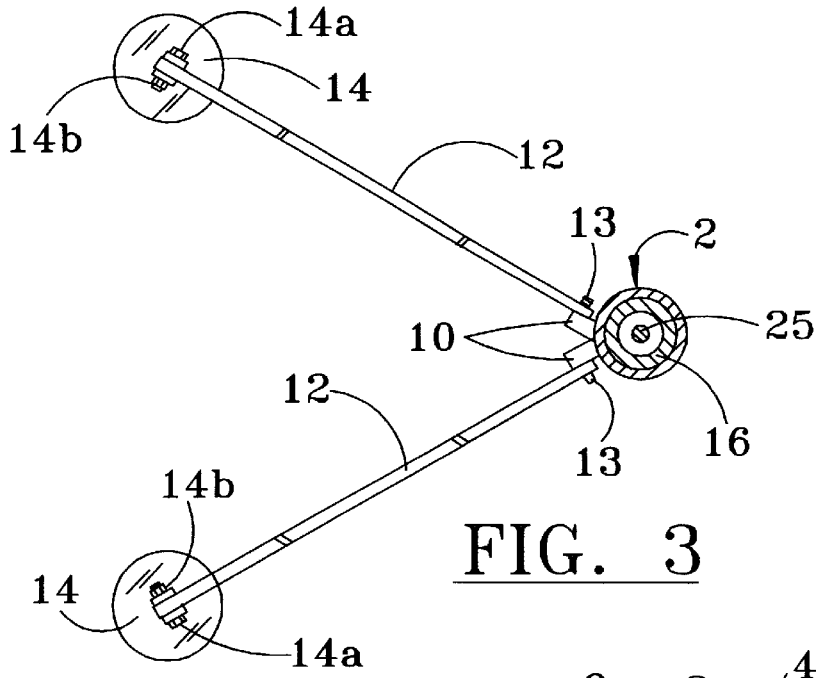
FIG. 3 is a sectional view taken along line 3—3 of the mount collar and mount shaft elements of the portable transducer mount illustrated in FIG. 2.
Figure 4:
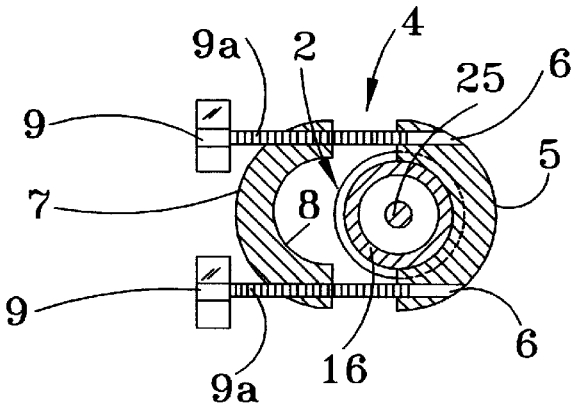
FIG. 4 is a sectional view taken along line 4—4 of the split collar clamp element of the portable transducer mount illustrated in FIG. 2.

Referring initially to FIGS. 1 and 2 of the drawing, in a preferred embodiment the portable transducer mount of this invention is generally illustrated by reference numeral 1 and includes an elongated, hollow mount shaft 16, typically constructed of fiberglass or metal and supported on the bow 32 of a barge 31 by means of a typically cylindrical mount collar 2, pivotally receiving a pair of diverging collar legs 12, as illustrated in FIGS. 2 and 3. The mount collar 2 extends from above the deck 33 of the barge 31, downwardly of the bow 32 to facilitate abrasion protection of the slidably-enclosed mount shaft 16. A split collar clamp 4 is fitted to the top end of the mount collar 2 and includes a fixed clamp segment 5, which is typically welded, bolted or otherwise fixed to the top end of the mount collar 2 and a movable clamp segment 7, which matches the fixed clamp segment 5, as further illustrated in FIG. 4. The fixed clamp segment 5 is fitted with parallel, spaced-apart, threaded fixed segment apertures 6, for threadably receiving the threaded pin shafts 9*a* of a pair of clamp pins 9, as further illustrated in FIG. 4. The pin shafts 9*a* also extend through corresponding movable segment apertures 8 provided in the movable clamp segment 7, to facilitate selectively tightening and loosening the movable clamp segment 7 on the mount shaft 16 above the mount collar 2 and vertically or rotatably adjusting the mount shaft 16 within the mount collar 2, as further hereinafter described. One end of a coil spring 18 is welded at a weld 23, or otherwise fixed to a hollow pin 19 which extends into the open bore of the mount shaft 16, is fixed in place by means of a bottom eye bolt 21 and a pin bolt 22, secured in the mount shaft 16 by an eye bolt nut 21*a* and a pin nut 22*a*, respectively, as further illustrated in FIG. 5. The bottom end of the coil spring 18 is welded at a weld 23 or otherwise fixed to a second hollow pin 19, receiving the top end of a hollow shaft leg 17, that extends the longitudinal axis of the mount shaft 16 below the spring 18, as further illustrated in FIG. 2. The top end of the hollow shaft leg 17 is secured inside the bore of the pin 19 by means of pin bolts 19*a* and corresponding pin nuts 19*b*, as further illustrated in FIG. 2.

Referring again to FIGS. 1–3 of the drawing, in another preferred embodiment of the invention the pair of collar legs 12 each has one end pivotally connected to the mount collar 2 by means of leg pins 13, extending through corresponding pivot pin brackets 10, attached to or shaped in the mount collar 2. A collar foot 14 is pivotally connected to the outer end of each of the collar legs 12 by means of a foot pin 14*a* and a foot pin nut 14*b*, for pivotally connecting the collar feet 14 to the collar legs 12 and thus, the mount sleeve 2 and the mount shaft 16, to the deck 33 of the barge 31. Each collar foot 14 may be fitted with a magnet (not illustrated) for magnetic attachment to the iron or steel deck 33. Pivotal or hinged attachment of the collar legs 12 to the mount collar 2 by means of the leg pins 13 in the pivot pin brackets 10 facilitates downward pivoting of the collar legs 12 substantially against the mount collar 2 when the portable transducer mount 1 is not in use, for carrying and storage purposes.

Figure 5:
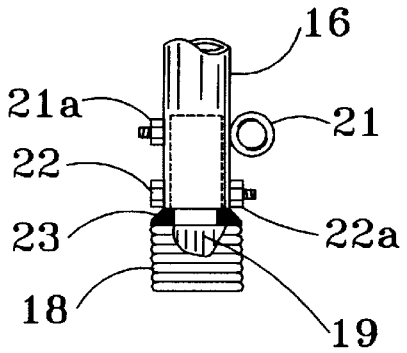
FIG. 5 is a sectional view taken along line 5—5 of the spring and pin assembly of the portable transducer mount illustrated in FIGS. 1 and 2.

Referring to FIGS. 2 and 5 of the drawing, the transducer 24 is mounted on the bottom end of the shaft leg 17 and is normally submerged in the water body 34 which floats the barge 31, as illustrated in FIG. 1. A transducer cable 25 is attached to the transducer 24 and extends upwardly through the hollow shaft leg 17, the hollow pins 19 and the spring 18, and exits the hollow mount shaft 16 at the top end thereof, as further illustrated in FIGS. 1 and 2. A cable plug 26 of conventional design is provided on the free end of the transducer cable 25 for attachment to a suitable conventional depth finder device (not illustrated), which is well known to those skilled in the art, to permit a continuous digital readout of the depth of the water body 34 and optionally, the topography of the water bottom, as the barge 31 moves through the water body 34 in the direction of the arrow illustrated in FIG. 1.

Figure 6:
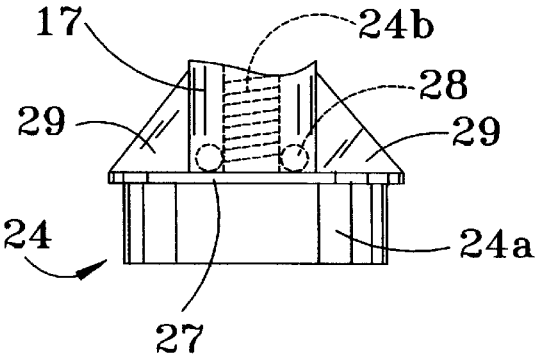
FIG. 6 is a sectional view of the bottom end of the shaft leg element of the portable transducer mount, more particularly illustrating a typical mounting of the transducer to the shaft leg.

Referring again to FIGS. 2 and 6 of the drawing, in a most preferred embodiment of the invention the transducer 24 is attached to the open bottom end of the hollow shaft leg 17 by initially inserting the transducer mount 24*b* through an aperture (not illustrated) in a transducer mounting plate 27, which is welded or otherwise fixed to both of a pair of gusset plates 29, which are then welded or otherwise fixed to the bottom end of the hollow shaft leg 17, as illustrated in FIG. 6. A transducer mount nut 28 is then threaded on the transducer mount 24*b* to removably secure the transducer foot 24*a* in place against the transducer mounting plate 27. The transducer mount 24*b* then extends into the open bore in the bottom end of the shaft leg 17, as further illustrated in FIG. 6.

Referring again to FIGS. 1 and 2 of the drawings, the portable transducer mount 1 is removably mounted in the functional position illustrated in FIG. 1 with the transducer 24 submerged beneath the surface of the water body 34, as follows: the collar legs 12, which are pivotally attached to the mount collar 2 of the portable transducer mount 1 at the pivot pin bracket 10 are first pivoted upwardly in a diverging pattern until the leg shoulders 12*a* seat against the cylindrical mount collar 2, as illustrated in FIG. 2. When the collar legs 12 are in the outwardly-extending mounting position illustrated in FIG. 2, the collar feet 14 pivotally contact the flat steel deck 33 of the barge 31 to secure the portable transducer mount 1 in the position illustrated in FIG. 1. One or two top cables or guys 20*b* are then extended from the top eye bolt 20, secured on the top of the mount shaft 16 by an eye bolt nut 20*a* to a cleat 35 or other mounting element on the deck 33 of the barge 31. An additional pair of bottom cables or guys 21*b* are extended from the bottom eye bolt 21, positioned immediately above the spring 18 and also secured on the mount shaft 16 by eye bolt nut 21, to a similar cleat 35 or the like. This cable or guy arrangement insures that the portable transducer mount 1 is stabilized in the position illustrated in FIG. 1 as the barge 31 traverses the water body 34 and the transducer 24 is maintained in a properly submerged condition beneath the surface of the water body 34.

Referring again to FIG. 1 of the drawing, under circumstances where either the transducer 24 or the shaft leg 17 strikes a submerged object or obstacle in the water body 34, the spring 18 provides sufficient resiliency and tension in the connection between the mount shaft 16 and the shaft leg 17 to allow the shaft leg 17 to deflect from the longitudinal centerline of the mount shaft 16 and the shaft leg 17 and prevent damage to either the shaft leg 17 or the mount shaft 16.

Under circumstances where it is desired to move the portable transducer mount 1 from the position mounted on the bow 32 of the barge 31, the top guy or guys 20*b* are first typically retrieved on the barge 31 and the portable transducer mount 1 is typically lifted from the deployed position illustrated in FIGS. 1 and 2 to a prone position on the deck 33 of the barge 31. The collar legs 12 can then be pivotally deployed downwardly on the leg pins 13 against the mount collar 2, as illustrated in phantom in FIG. 2. The top guide wires 20*b* and the bottom guide wires 21*b* can then be detached from the respective cleats 35 of the barge 31, as well as the bottom eye bolts 21, if necessary, and the portable transducer mount 1 may then be easily carried to storage or to an alternative use location, as desired.

Referring again to FIGS. 1, 2 and 4 of the drawings, it will be appreciated by those skilled in the art that the portable transducer mount 1 of this invention can be vertically adjusted to submerge the transducer 24 to any desired depth in the water body 34, as well as rotationally adjusted to properly orient the transducer 24 in the water, as follows: in order to more deeply submerge the transducer 24 in the water body 34 from the position illustrated in FIG. 1, the respective clamp pins 9 are manipulated to loosen the pin shafts 9*a* in the threaded fixed segment clamp apertures 6 of the fixed clamp segment 5 and movable segment apertures 8 of the movable clamp segment 7 and facilitate sliding of the mount shaft 16 downwardly inside the collar clamp 4 and the mount sleeve 2. Tightening of the respective clamp pins 9 again secures the mount shaft 16 inside the collar clamp 4 and the mount sleeve 2, with the transducer 24 deployed at the new depth, as desired. Rotational adjustment of the mount shaft 16 can be effected to a limited extent by the same procedure, to maintain the transducer 24 in a desired submerged rotational orientation. Moreover, the portable transducer mount 1 can be mounted at any desired point on the typically flat bow 32 of the barge 31, subject to the location of the cleats 35 or alternative guy anchors.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A portable transducer mount for mounting a transducer on a vessel floating on a water body, comprising a mount collar positioned adjacent to the vessel; at least one collar leg extending from said mount collar, said collar leg engaging the vessel for supporting said mount collar on the vessel; a mount shaft slidably engaging said mount collar, with one end of said mount shaft extending from said mount collar above the vessel and the opposite end of said mount shaft from said one end extending from said mount collar and submerged in the water body for carrying and submerging the transducer; a spring provided at said opposite end of said mount shaft above said transducer for deflecting said transducer responsive to striking of a submerged object by said opposite end of said mount shaft; and at least one cable connecting said mount shaft to the vessel for stabilizing said mount shaft on the vessel.

2. The portable transducer mount of claim 1 comprising a pin provided at said spring for attaching said spring to said opposite end of said mount shaft.

3. The portable transducer mount of claim 1 comprising a clamp provided in said mount collar, said clamp selectively engaging said mount shaft for adjustably securing said mount shaft in said clamp and said mount collar responsive to manipulation of said clamp.

4. The portable transducer mount of claim 3 comprising a spring provided in said opposite end of said mount shaft above said transducer for deflecting said transducer responsive to striking of a submerged object by said opposite end of said mount shaft.

5. The portable transducer mount of claim 4 comprising a pin provided at said spring for attaching said spring to said opposite end of said mount shaft.

6. The portable transducer mount of claim 1 comprising a pivot provided on said collar leg and said mount collar for selectively pivoting said collar leg into engagement with the vessel and said mount collar.

7. The portable transducer mount of claim 1 comprising a foot pivotally provided on said collar leg for pivotally contacting the vessel.

8. The portable transducer mount of claim 1 comprising:

(a) a pivot provided on said collar leg and said mount collar for selectively pivoting said collar leg means into engagement with the vessel and said mount collar; and (b) a foot pivotally provided on said collar leg at said pivot for pivotally contacting the vessel.

9. The portable transducer mount of claim 8 comprising a spring provided at said opposite end of said mount shaft above said transducer for deflecting said transducer responsive to striking of a submerged object by said opposite end of said mount shaft.

10. The portable transducer of claim 9 comprising a pin provided at said spring for attaching said spring to said opposite end of said mount shaft.

11. A portable transducer mount for mounting a transducer on a vessel floating on a body of water, comprising a hollow mount collar disposed adjacent to the vessel; an elongated mount shaft extending slidably through said mount collar, with one end of said mount shaft projecting above the bow of the vessel and the opposite end of said mount shaft mounting the transducer and extending into the water; a clamp provided on said mount collar, said clamp selectively engaging said mount shaft for slidably and rotatably adjusting said mount shaft in said mount collar; a pair of collar legs carried by said mount collar, said collar legs removably engaging the vessel for supporting said mount collar and said mount shaft on the vessel; a spring provided in said opposite end of said mount shaft above the transducer for flexing when said transducer strikes a submerged object; and cables connecting said mount shaft to the vessel for stabilizing said mount shaft on the vessel.

12. The portable transducer mount of claim 11 comprising a pin provided at said spring for attaching said spring to said opposite end of said mount shaft.

13. The portable transducer mount of claim 11 comprising a pivot provided on each of said collar legs and said mount collar for selectively pivoting said collar legs into engagement with the vessel and said mount collar.

14. The portable transducer mount of claim 11 comprising feet pivotally provided on said collar legs for pivotally engaging the vessel.

15. The portable transducer mount of claim 11 comprising:

(a) a pivot provided on each of said collar legs and said mount collar for selectively pivoting said collar leg into engagement with the vessel and said mount collar; and (b) feet pivotally provided on said collar legs for pivotally engaging the vessel.

16. The portable transducer mount of claim 15 comprising a pin provided at said spring for attaching said spring to said opposite end of said mount shaft.

17. A portable transducer mount for mounting a transducer on the bow of a barge floating on a body of water, comprising a hollow mount collar disposed adjacent to the bow; an elongated mount shaft slidably engaging said mount collar, with one end of said mount shaft projecting above the bow of the barge and the opposite end of said mount shaft mounting the transducer and extending into the water; a clamp provided on said mount collar, said clamp selectively engaging said mount shaft for slidably and rotatably adjusting said mount shaft in said mount collar; a pair of collar legs pivotally carried by said mount collar, said collar legs engaging the bow of the barge for supporting said mount collar and said mount shaft on the bow; a coil spring provided in said opposite end of said mount shaft above the transducer for flexing when said transducer strikes a submerged object; and cables connecting said mount shaft to the bow for stabilizing said mount shaft on the bow of the barge.

18. The portable transducer mount of claim 17 comprising a pin provided at said spring for attaching said spring to said opposite end of said mount shaft.

19. The portable transducer mount of claim 18 comprising feet pivotally provided on said collar legs for pivotally engaging the bow of the barge.

* * * * *